US008141615B1

(12) United States Patent
Ferrando et al.

(10) Patent No.: US 8,141,615 B1
(45) Date of Patent: Mar. 27, 2012

(54) ALUMINUM ENGINE CYLINDER LINER AND METHOD

(75) Inventors: William A. Ferrando, Arlington, VA (US); Catherine R. Wong, Germantown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 435 days.

(21) Appl. No.: 12/545,095

(22) Filed: Aug. 21, 2009

(51) Int. Cl.
*B22D 19/14* (2006.01)
*B22D 13/00* (2006.01)
*F02F 1/00* (2006.01)

(52) U.S. Cl. ..... 164/97; 164/114; 123/193.2

(58) Field of Classification Search ..... 164/114, 164/97; 123/193.2
See application file for complete search history.

(56) References Cited

U.S. PATENT DOCUMENTS

| | | | | |
|---|---|---|---|---|
| 3,536,123 | A * | 10/1970 | Izumi | 164/114 |
| 4,708,104 | A | 11/1987 | Day et al. | |
| 5,002,115 | A | 3/1991 | Noordegraaf et al. | |
| 5,025,849 | A | 6/1991 | Karmarkar et al. | |
| 5,337,803 | A | 8/1994 | Divecha et al. | |
| 5,360,662 | A | 11/1994 | Wong | |
| 6,082,436 | A | 7/2000 | Divecha et al. | |
| 6,311,491 | B1 * | 11/2001 | Conrad | 60/520 |
| 2007/0277771 | A1 * | 12/2007 | Holtan et al. | 123/193.2 |
| 2008/0060723 | A1 * | 3/2008 | Doty | 148/549 |

* cited by examiner

*Primary Examiner* — Kevin P Kerns
(74) *Attorney, Agent, or Firm* — Richard A. Morgan

(57) ABSTRACT

A method has been found for centrifugal casting engine cylinders. A mold is charged with molten aluminum alloy and particulate silicon monoxide having an average size of 0.01 mm to 0.04 mm. The mold is rotated at a velocity and period of time to distribute the particulate silicon monoxide on an inner cylinder surface. The mold is allowed to cool until the aluminum alloy solidifies. A casting is demolded characterized in a uniform inner cylinder surface of the particulate silicon monoxide in an amount of 25 volume % and thickness 1 to 5 millimeters. The engine cylinders are distinguished in resistance to wear. Cylinder liners show no appreciable wear for over 100,000 miles of use.

11 Claims, No Drawings

ALUMINUM ENGINE CYLINDER LINER AND METHOD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to metal founding. More particularly, the invention relates to centrifugal casting liquid metal. More particularly the invention relates to forming a composite article incorporating particulate matter.

2. Discussion of the Related Art

Light weight internal combustion engines have necessitated the use of aluminum and aluminum alloys for engine cylinder blocks, cylinders and cylinder heads. To make up for the deficiencies in physical properties of aluminum and aluminum alloy engines, working surfaces have been coated with materials with better physical properties to improve working life and performance of the engines. Specifically, the inner surface of cylinders has been coated with a hard inner layer to improve wear performance. In the alternative, a hard face liner/sleeve is inserted into cylinders for the same purpose.

The hard inner layer can be applied by metal matrix composite (MMC) casting a silicon carbide (SiC) layer on the cylinder surface to form a composite. This is done by weaving a cylindrical structure of silicon carbide (SiC) fibers and pressure casting with aluminum alloy. The process is used primarily for racing engines where performance is a greater concern than cost.

Centrifugal casting is a less costly method of forming cylindrical parts. Centrifugal casting has been used to cast aluminum and aluminum alloy parts in combination with particulate matter to improve physical properties of the engine part. There are four requirements for a particle to be successful for inner surface hardening of aluminum by centrifugal casting. First, the particle must be hard compared to the hardness of the aluminum or aluminum alloy. Second, the particle must have a density lower than that of liquid aluminum. Third, the particle must have a significantly higher melting temperature than that of aluminum or aluminum alloy. Fourth, the particle must be able to wet the aluminum without dissolving or significantly reacting with it.

These requirements have not been fully met by methods and materials used in the art.

SUMMARY OF THE INVENTION

A method has been found for centrifugal casting a cylinder. A mold is charged with molten aluminum or aluminum alloy. The mold is also charged with a particulate silicon monoxide having an average particle size of 0.25 millimeters (mm) or less. The mold is rotated to distribute the particulate matter on an inner cylinder surface. The mold is allowed to cool until the aluminum or aluminum alloy solidifies. A casting is demolded. The casting is characterized in a uniform silicon monoxide coating on an inner cylinder surface.

The method is used to produce internal combustion engine cylinders and specifically cylinder liners distinguished in resistance to wear. Cylinder liners can be expected to show no appreciable wear for over 100,000 miles of use.

DETAILED DESCRIPTION OF THE INVENTION

Aluminum alloys used to cast cylinders for internal combustion engines comprise a major proportion of aluminum and a minor proportion of alloying metals. The densities of these aluminum alloys and the density of aluminum do not differ significantly for the purpose of this invention.

Solid aluminum has a density of 2.70 grams/cm$^3$ (0.097 lb/in$^3$) at ambient temperature and a coefficient of thermal expansion of 25 μcm/cm/° C.×10$^{-6}$ (13.89 μin/in/° F.×10$^{-6}$). Liquid aluminum has a density of 2.377 grams/cm$^3$ (0.085 lb/in$^3$) at the melting temperature of 660.32° C. As the aluminum is heated, the density drops linearly to about 2.302 grams/cm$^3$ (0.083 lb/in$^3$) at 902° C.

The preferred aluminum metals are aluminum alloys. The preferred aluminum alloys are alloy A380 and alloy A390. Alloy A380 is used for die casting, especially for transmissions and gear housings. Alloy A390 is used for die casting automotive engine blocks. Relevant physical properties of these alloys are as follows.

1. As cast aluminum alloy A380
   Nominal composition: S±8.5 vol %, Cu 3.5 vol %
   Density: @20° C. 2.74 gram/cm$^3$
   @68° F. 0.099 lb/in$^3$
   Melting range: 540° C.-595° C. (1000° F.-1100° F.)
   Coefficient of Thermal Expansion:
   22.0 μcm/cm/° C.×10$^{-6}$
   12.2 μin/in/° F.×10$^{-6}$
   Demonstrates better than average mechanical machining.
2. As cast aluminum alloy A390
   Nominal Composition: S±17 vol %, Cu 4.5 vol %
   Density: @20° C. 2.73 gram/cm$^3$
   @68° F. 0.098 lb/in$^3$
   Melting range: 510° C.-650° C. (950° F.-1200° F.)
   Coefficient of Thermal Expansion:
   18.0 μcm/cm/° C.×10$^{-6}$
   10 μin/in/° F.×10$^{-6}$
   Demonstrates among the least susceptibility to mechanical machining and demonstrates corresponding greatest resistance to wear. This is attributed to the high silicon content and free silicon content.

Silicon monoxide is insoluble in aluminum at all temperatures and remains in the solid state at molding temperatures. The particles used in the invention have a density significantly lower than that of aluminum and aluminum alloys. Silicon monoxide (SiO) has a density of 2.13 to 2.28 gram/cm$^3$ at a melting temperature of 1775° C. This is compared to silicon dioxide ($SiO_2$) which has a density of 2.634 gram/cm$^3$ at a melting temperature of 1650° C. Coefficient of thermal expansion of silicon dioxide is 5.5 μcm/cm/° C.×10$^{-7}$ (3.06 μin/in/° F.×10$^{-7}$).

Other useful particles having a density less than that of liquid aluminum and liquid aluminum alloy are tridymite (density 2.20 grams/cm$^3$), cristobalite (density 2.32 grams/cm$^3$) and opal (density 2.17 grams/cm$^3$). However, these materials are not as commercially useful or available as silicon monoxide.

TABLE 1

| Particulate Silica Specie | Density gm/cm$^3$ | Mohs Hardness | Formula/Crystal |
|---|---|---|---|
| α-Quartz (abundant) | 2.65 | 7 | $SiO_2$/4-tetrahedral |

TABLE 1-continued

| Particulate Silica Specie | Density gm/cm$^3$ | Mohs Hardness | Formula/Crystal |
|---|---|---|---|
| β-Quartz (rare) | 2.53 | Not stable below 573° C. | $SiO_2$/4-tetrahedral |
| Silicon Monoxide | 2.13-2.28 | 7 | SiO |
| α-Tridymite (common) | 2.35 | 6½-7 | $SiO_2$/4-tetrahedral |
| β-Tridymite (rare) | 2.25 | Not stable below 870° C. | $SiO_2$/4-tetrahedral |
| α-Cristobalite (common) | 2.33 | 6½ | $SiO_2$/4-tetrahedral |
| β-Cristobalite (rare) | 2.27 | Not stable below 1470° C. | $SiO_2$/4-tetrahedral |
| Opal (very common) | 1.9-2.5 | 5½-6 | $SiO_2 \bullet nH_2O$/4-tetrahedral |
| Lechatelierite (rare) | 2.20 | 6½ | $SiO_2$/4-tetrahedral |

Silicon monoxide has a Mohs hardness of about 7 which is about the hardness of silicon. This compares with the Mohs hardness of aluminum and aluminum alloys in the range of 2.0 to 2.9. The Mohs hardness of steel is in the range of 5 to 8.5.

Silicon monoxide powder is used for making ceramics. When selecting silicon monoxide from a commercial source, it is essential to look beyond a nominal product assay. It is not uncommon to find that product intended for use in ceramics, labeled silicon monoxide (SiO), is in fact an equi-molar mixture of silicon dioxide ($SiO_2$) and silicon. A nominal product assay could indicate that the material was silicon monoxide (SiO), when essentially none of the monoxide specie is present. Silicon monoxide is a brown powder having a density of 2.13 gram/cm$^3$, made by chemically reducing silicon dioxide. Silicon dioxide is a white powder having a density of 2.634 gram/cm$^3$, made by grinding quartz to powder form. Neither silicon nor silicon dioxide is used in the invention.

Silicon monoxide powder is made by grinding and sieving the brown-black glassy solid crude product to the desired particle size. Powders of the invention have an average particle size of 0.250 mm and less. It is essential that the powders provide a smooth surface in the casting. It is therefore preferred that the powders have an average particle size of 0.10 mm or less. The preferred powders for use in the invention have an average particle size of 0.01 millimeter to 0.10 millimeter. The most preferred powders for smoothness and packing have an average particle size of 0.01 millimeter to 0.04 millimeter. A U.S. sieve size No. 325 silicon monoxide powder is commercially available.

TABLE 2

| Particle size millimeters (mm) | U.S. Sieve Size |
|---|---|
| 0.250 mm | No. 60 |
| 0.210 mm | No. 70 |
| 0.177 mm | No. 80 |
| 0.149 mm | No. 100 |
| 0.125 mm | No. 120 |
| 0.105 mm | No. 140 |
| 0.088 mm | No. 170 |
| 0.074 mm | No. 200 |
| 0.040 mm | No. 325 |
| 0.037 mm | No. 400 |
| 0.018 mm | No. 800 |
| 0.005 mm | No. 3000 |

Molten aluminum or aluminum alloy along with particulate silicon monoxide are introduced into the rotating mold. The amount of silicon monoxide is determined in view of the final product. It is desirable to have a silicon monoxide thickness on the surface of at least about 1 millimeter, preferably about 1 millimeter to about 5 millimeters. The silicon monoxide is present for smoothness and resistance to surface wear. A thicker surface layer does not improve resistance to surface wear. For best bonding between the particles, it is best to surround each silicon monoxide particle with an equal diameter of the aluminum or aluminum alloy. This is achieved in the 1 millimeter to 5 millimeter thick toroidal volume comprising the inner mold face with about 25% to 30% by volume of silicon monoxide. The amount of silicon monoxide charged should be the amount that yields this density after centrifuging. The coefficient of thermal expansion of the aluminum or aluminum alloy enhances the bonding on cooling of the centrifuged casting. The result is a uniform layer of silicon monoxide particles with no holes or pits.

The force on the mold is a function of the mold diameter and the revolutions per minute (RPM) of the mold. It is preferred to apply a centrifugal force to the composite being cast of about 80 to 160 times the force of gravity (G's). This is may be achieved by rotating the mold at a speed as high as 5000 rpm. Typically the speed of rotation is about 1000 rpm to 3000 rpm.

The size of cylindrical shapes is limited by the size of the cylindrical casting mold used. In general, the practical limits are cylinders 10 feet in diameter and 50 feet in length. Wall thickness can be 0.1 to 5 inches. The preferred use of the invention is to make a cylinder liner/sleeve for an internal combustion engine. Cylinder liners can be made with face hardness approaching that of silicon monoxide.

The coefficient of thermal expansion (CTE) is 25 μcm/cm/° C.$\times 10^{-6}$ (13.89 μin/in/° F.$\times 10^{-6}$) for aluminum. The coefficient of thermal expansion of silicon monoxide is not reported, but is thought be about the same as that of silicon dioxide, 5.5 μcm/cm/° C.$\times 10^{-7}$(3.06 μin/in/° F.$\times 10^{-7}$). These coefficients indicate that the aluminum will contract tightly around the hard silicon monoxide particles as the material cools after centrifugal casting, leaving no spaces.

During use in an engine, the casting is subjected to explosive combustion, placing the casting under tension. During installation in an engine block, the casting is subjected to pre-conditioning to fortify the particle rich, inside layer against micro-cracking. The slightly oversized casting is put into pre-compression when being installed. The block is heated or the cylinder is cool or both while the cylinder is pressed into the block. This technique is well known in the art.

This invention is shown by way of Example.

Example 1

A quantity of silicon monoxide was supplied by Johnson Matthey, Inc., Ward Hill, Mass. 01835. The material was visually inspected and it had the black appearance of silicon monoxide. Density of the material supplied was given as 2.13 gram/cm$^3$. Melting temperature was given as 1702° C.

A 50 gram sample of the silicon monoxide was ground by hand to 60 meshes and ball milled with 5 gram flux (ALBRAL Type 2 aluminum fluoride/sodium aluminum fluoride, FOSECO Metallurgical, Inc., Cleveland Ohio 44142) for one hour. A charge of 2560 grams 99.5% Al (Belmont Metals, Inc., Brooklyn, N.Y. 11207) was placed in a clay bonded graphite crucible. The fluxed SiO was placed in a feed hopper affixed to the crucible cover. The cover contained an impeller type molybdenum stirrer. The charge was induction heated to about 770° C. The powder was fed into the liquid Al under argon atmosphere while stirring vigorously. Simultaneously, a steel mold, having an inner diameter of 5.4 inches, attached to a vertical centrifugal casting machine, was heated to about 500° C. The mold was rotated at 1750 rpm, and the Al alloy/SiO mixture was poured in. The resulting cylindrical casting was demolded and photographed.

A cross sectional wedge of the casting was cut and mounted. The sample was polished using successive sized grits of diamond paste until the appearance was satisfactory for photographing. A low power optical photograph of the sample showed a band of dark SiO particles clustered around the cylinder inner diameter. Examination of the polished particles at higher magnification indicated direct aluminum particle contact with little reaction. Beyond this band of dark SiO particles an almost featureless surface was noted, with only a few particles with very little eutectoid Si. These features supported the conclusion that the particles had bonded to the aluminum grains with little reaction and were be concentrated by centrifugal casting.

The observed wide size distribution of particles resulted from hand crushing the SiO to pass through a 60 mesh sieve from its original 3 to 6 millimeter size. The result would have been more uniform if the size distribution of the starting SiO powder had been narrowed by mechanical grinding and sieving.

Example 2

The procedure of Example 1 was repeated, except that aluminum alloy A356 was used. Alloy A356 is a 7 Si, 0.3 Mg alloy with 0.2 Fe (max) and 0.10 Zn (max). The cylinder was demolded, sectioned, polished and photographed. The photograph showed a distribution of SiO particles sizes attributed to hand grinding of the powder. A significant Si eutectoid content was observed. Particle density was measured. There was a concentration of about 6% by volume of SiO in the inner face band and 2% by volume remained in the bulk of the casting.

About 13% by volume eutectoid Si was observed in the center and about 8% by volume in the bulk of the casting. This could have been due to either a significant interaction between the matrix and the SiO, or a simultaneous centrifugal concentration of the eutectoid. This could have occurred from either a significant interaction between the aluminum grains and the SiO or a simultaneous centrifugal concentration of the eutectoid. Although theoretically possible, the latter alternative seems unlikely.

The foregoing discussion discloses and describes embodiments of the invention by way of example. One skilled in the art will readily recognize from this discussion, that various changes, modifications and variations can be made therein without departing from the spirit and scope of the invention as defined in the following claims.

What is claimed is:

1. A method of centrifugal casting an aluminum cylinder, comprising the steps of:

a. charging a mold with an amount of particulate silicon monoxide having an average size of 0.25 mm or less and a molten aluminum metal selected from the group consisting of aluminum and aluminum alloy;

b. rotating the mold and distributing the particulate silicon monoxide on an interior cylinder surface of the mold;

c. allowing the mold to cool; and d. demolding an aluminum metal casting characterized in a 1 to 5 millimeter thick toroidal volume comprising 25% to 30% by volume particulate silicon monoxide with an inner cylindrical surface characterized in uniformly distributed particulate silicon monoxide bonded to the aluminum metal.

2. The method of claim 1 wherein in step a. the aluminum metal is an aluminum alloy comprising silicon.

3. The method of claim 1 wherein in step a. the aluminum metal is an aluminum alloy selected from the group consisting of alloy A380 and alloy A390.

4. The method of claim 1 wherein the particulate silicon monoxide has an average size of 0.01 millimeter to 0.1 millimeter.

5. The method of claim 1 wherein the particulate silicon monoxide has an average size of 0.01 millimeter to 0.04 millimeter.

6. In a method for centrifugal casting a cylinder made of aluminum or aluminum alloy metal, wherein the improvement comprises charging a mold with the molten metal and an amount of particulate silicon monoxide having an average size of 0.25 mm or less and rotating to uniformly distribute the particulate silicon monoxide on an inner mold face at a density of 25% to 30% by volume and a thickness of at least about 1 millimeter to about 5 millimeters.

7. The method of claim 6 wherein the particulate silicon monoxide has an average size of 0.01 millimeter to 0.1 millimeter.

8. The method of claim 6 wherein the particulate silicon monoxide has an average size of 0.01 millimeter to 0.04 millimeter.

9. An engine cylinder liner made by the method of centrifugal casting an aluminum metal selected from the group consisting of aluminum and aluminum alloy with a particulate silicon monoxide, the cylinder liner characterized in a 1 to 5 millimeter thick toroidal volume comprising 25% to 30% by volume particulate silicon monoxide and an inner cylindrical face characterized in uniformly distributed particulate silicon monoxide bonded to the aluminum metal.

10. The engine cylinder liner of claim 9 wherein the particulate silicon monoxide has an average size of 0.01 millimeter to 0.1 millimeter.

11. The engine cylinder liner of claim 9 wherein the particulate silicon monoxide has an average size of 0.01 millimeter to 0.04 millimeter.

* * * * *